US010260437B2

(12) United States Patent
Amano

(10) Patent No.: US 10,260,437 B2
(45) Date of Patent: Apr. 16, 2019

(54) CONTROL DEVICE FOR INTERNAL COMBUSTION ENGINE WITH CYLINDER DEACTIVATION

(71) Applicant: TOYOTA JIDOSHA KABUSHIKI KAISHA, Toyota-shi, Aichi-ken (JP)

(72) Inventor: Takashi Amano, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 7 days.

(21) Appl. No.: 15/314,662

(22) PCT Filed: Jun. 2, 2015

(86) PCT No.: PCT/IB2015/000921
§ 371 (c)(1),
(2) Date: Nov. 29, 2016

(87) PCT Pub. No.: WO2015/185986
PCT Pub. Date: Dec. 10, 2015

(65) Prior Publication Data

US 2017/0211491 A1 Jul. 27, 2017

(30) Foreign Application Priority Data

Jun. 4, 2014 (JP) ..... 2014-115666

(51) Int. Cl.
*F01P 7/16* (2006.01)
*F02D 41/00* (2006.01)
*F02D 35/02* (2006.01)

(52) U.S. Cl.
CPC ..... *F02D 41/0087* (2013.01); *F01P 7/165* (2013.01); *F02D 35/025* (2013.01)

(58) Field of Classification Search
CPC ..... F02D 41/0087; F02D 41/26; F02D 13/06; F01P 11/16
See application file for complete search history.

(56) References Cited

U.S. PATENT DOCUMENTS 5,555,871 A * 9/1996 Gopp ..... F02B 75/22 123/198 D
5,713,383 A * 2/1998 Ramirez ..... E04H 15/62 135/118

(Continued)

FOREIGN PATENT DOCUMENTS

JP 6-159110 6/1994
JP 2008-128017 6/2008

*Primary Examiner* — Long T Tran
(74) *Attorney, Agent, or Firm* — Finnegan, Henderson, Farabow, Garrett & Dunner, LLP

(57) ABSTRACT

A control device for an internal combustion engine is provided. The internal combustion engine is configured to perform switching between an all-cylinder operation and a partial cylinder operation. The internal combustion engine includes a temperature regulator. The temperature regulator is configured to separately regulate the temperature of an operating cylinder and the temperature of a paused cylinder. The operating cylinder is a cylinder that operates during the partial cylinder operation. The paused cylinder is a cylinder that is paused during the partial cylinder operation. The control device includes an electronic control unit. The electronic control unit is configured to (i) calculate a temperature difference between the operating cylinder and the paused cylinder during the partial cylinder operation, and (ii) control the temperature regulator such that the temperature difference becomes equal to or smaller than a predetermined threshold.

5 Claims, 10 Drawing Sheets

(56) References Cited

U.S. PATENT DOCUMENTS

| | | | | |
|---|---|---|---|---|
| 5,813,383 | A * | 9/1998 | Cummings | F01L 1/146 123/145 A |
| 6,786,191 | B2 * | 9/2004 | Foster | B60H 1/00314 123/198 F |
| 7,966,978 | B2 * | 6/2011 | Maehara | F02D 13/06 123/198 DB |
| 8,893,667 | B2 * | 11/2014 | Shimoyama | F01P 7/14 123/198 DB |
| 2005/0049108 | A1 * | 3/2005 | Nishizawa | B60W 10/06 477/37 |
| 2009/0000576 | A1 * | 1/2009 | Maehara | F02D 13/06 123/41.02 |
| 2009/0133662 | A1 * | 5/2009 | Hartmann | F02D 17/02 123/198 DC |
| 2009/0282807 | A1 * | 11/2009 | Rioli | F02D 17/02 60/276 |
| 2010/0251977 | A1 | 10/2010 | Warchuck | |
| 2011/0265741 | A1 * | 11/2011 | Honzen | F01P 3/02 123/41.08 |
| 2013/0186351 | A1 * | 7/2013 | Quix | F01P 5/10 123/41.02 |
| 2014/0020641 | A1 * | 1/2014 | Shimoyama | F01P 7/14 123/41.52 |
| 2014/0222311 | A1 * | 8/2014 | Sasaki | F02D 13/08 701/102 |
| 2014/0245993 | A1 * | 9/2014 | Weber | F02D 13/06 123/349 |

* cited by examiner

CONTROL DEVICE FOR INTERNAL COMBUSTION ENGINE WITH CYLINDER DEACTIVATION

CROSS-REFERENCE TO RELATED APPLICATIONS

This application is a national phase application of International Application No. PCT/IB2015/000921, filed Jun. 2, 2015, and claims the priority of Japanese Application No. 2014-115666, filed Jun. 4, 2014, the content of both of which is incorporated herein by reference.

BACKGROUND OF THE INVENTION

1. Field of the Invention

The present invention relates to a technical field of a control device for an internal combustion engine capable of performing operation with some cylinders being paused.

2. Description of the Related Art

In internal combustion engines capable of performing switching between an all-cylinder operation and a partial cylinder operation, the control of suppressing the temperature difference between the operating cylinder and the paused cylinder is executed such that the combustion balance between cylinders is not collapsed, for example, by performing the partial cylinder operation. For example, in Japanese Patent Application Publication No. 2008-128017 (JP 2008-128017 A) and Japanese Patent Application Publication No. 06-159110 (JP 06-159110 A), techniques of suppressing the occurrence of a temperature difference by sequentially transposing an operating cylinder and a paused cylinder during the partial cylinder operation is suggested.

SUMMARY OF THE INVENTION

However, since the techniques described in JP 2008-128017 A and JP 06-159110 A require that the operational states of respective cylinders are switched at a suitable timing, technical problems occur in that control becomes complicated. The transposition between the operating cylinder and the paused cylinder during the partial cylinder operation has a concern that fuel efficiency deterioration or vibration deterioration may occur depending on circumstances. That is, new trouble may occur by executing the control for suppressing the temperature difference.

The invention provides a control device for an internal combustion engine capable of suitably executing a partial cylinder operation.

A control device for an internal combustion engine related to an aspect of the invention is provided. The internal combustion engine is configured to perform switching between an all-cylinder operation and a partial cylinder operation. The internal combustion engine includes a temperature regulator. The temperature regulator is configured to separately regulate the temperature of an operating cylinder and the temperature of a paused cylinder. The operating cylinder is a cylinder that operates during the partial cylinder operation. The paused cylinder is a cylinder that is paused during the partial cylinder operation. The control device includes an electronic control unit. The electronic control unit is configured to calculate a temperature difference between the operating cylinder and the paused cylinder during the partial cylinder operation. The electronic control unit is configured to control the temperature regulator such that the temperature difference becomes equal to or smaller than a predetermined threshold.

The internal combustion engine related to the above aspect is configured as, for example, a power element capable of supplying power to a driving shaft of a vehicle. The internal combustion engine related to the above aspect is configured to perform switching between the all-cylinder operation and the partial cylinder operation. Specifically, the internal combustion engine is configured to perform operation by performing mutual switching between a state where all of a plurality of cylinders of the internal combustion engine are operated (namely, the all-cylinder operation) and a state where at least one of the plurality of cylinders of the internal combustion engine is paused and the other cylinders are operated (namely, the partial cylinder operation). By performing the partial cylinder operation, an improvement in fuel efficiency can be realized, for example, compared to a case where only the all-cylinder operation is performed. The switching between the all-cylinder operation and the partial cylinder operation is appropriately executed in accordance to, for example, output torque, thermal efficiency, or the like that is required for the internal combustion engine.

The control device for an internal combustion engine related to the above aspect is a device that controls the above-described internal combustion engine, and executes, particularly, the temperature control of the cylinders during the partial cylinder operation. The control device for an internal combustion engine includes the temperature regulator that separately regulates the temperature of the operating cylinder that is the cylinder that operates in the partial cylinder operation and the temperature of the paused cylinder that is paused in the partial cylinder operation, as means for regulating the temperatures of the cylinders. The temperature regulator is configured to be capable of respectively regulating the temperature of the operating cylinder and the temperature of the paused cylinder, for example, through selective water conduction of the cooling water. However, the configuration of the temperature regulator is not particularly limited, and various configurations can be adopted as long as the temperature of the operating cylinder and the paused cylinder can be separately regulated.

In addition, it is desirable that the temperature regulator is capable of collectively regulating the temperature of all cylinders included in an operating cylinder group (a plurality of operating cylinders) or a paused cylinder group (a plurality of paused cylinders). However, for example, the temperature (for example, mean temperature) of all of the plurality of cylinders included in the operating cylinder group or the paused cylinder group may be regulated by regulating the temperature of some cylinders included in the operating cylinder group or the paused cylinder group.

During the operation of the control device for an internal combustion engine related to an above aspect, the temperature difference between the operating cylinder and the paused cylinder during the partial cylinder operation is first calculated by the ECU. In addition, when the internal combustion engine performs only the all-cylinder operation, a temperature difference is hardly caused between the cylinders. However, when the partial cylinder operation is performed as in the internal combustion engine related to the invention, a rise in the temperature of the paused cylinder is suppressed, while the temperature of the operating cylinder rises high. For this reason, typically, it is considered that, as the period of the partial cylinder operation becomes longer, the temperature difference between the operating cylinder group and the paused cylinder group becomes larger.

Incidentally, the temperature difference between the operating cylinder group and the paused cylinder group may not be calculated using the temperature of all the cylinders included in the operating cylinder group and the paused cylinder group. For example, the temperature difference between the operating cylinder group and the paused cylinder group may be calculated as a difference between the mean temperature of the plurality of cylinders included in the operating cylinder group and the mean temperature of the plurality of cylinders included in the paused cylinder group, or may be calculated as a difference between the temperature of one arbitrary cylinder included in the operating cylinder group and the temperature of one arbitrary cylinder included in the paused cylinder group. The temperature difference between the operating cylinder group and the paused cylinder group may be calculated using a temperature directly detected by a sensor or the like, or may be calculated using a temperature indirectly detected (in other words, estimated) from other parameters.

If the temperature difference between the operating cylinder and the paused cylinder is calculated, the control of the temperature regulator by the electronic control unit is executed in accordance with the calculated temperature difference. Specifically, the electronic control unit controls the temperature regulator such that the temperature difference between the operating cylinder and the paused cylinder becomes equal to or smaller than the predetermined threshold. In addition, the "predetermined threshold" herein is a threshold for determining whether or not the temperature difference between the operating cylinder group and the paused cylinder group is large to such a degree that trouble may occur in the internal combustion engine, and can be set, for example, by performing the operation simulation of the internal combustion engine in advance.

The trouble that may occur as the temperature difference between the operating cylinder and the paused cylinder becomes larger includes, for example, torque unbalance between the cylinders. Since the torque unbalance between the cylinders causes torque fluctuations or vehicle vibration, for example, when switching from the partial cylinder operation to the all-cylinder operation is performed, it is desirable to generate as little torque unbalance as possible.

However, in the above aspect, as described above, the temperature difference between the operating cylinder and the paused cylinder is controlled so as to become equal to or smaller than the predetermined threshold. Specifically, when the temperature difference between the operating cylinder and the paused cylinder is large to such a degree that trouble may be caused, the temperature regulator is controlled and the temperature difference between the operating cylinder and the paused cylinder is made smaller. Therefore, it is possible to suitably suppress the occurrence of trouble resulting from the temperature difference between the operating cylinder and the paused cylinder.

As described above, according to the control device for an internal combustion engine related to the above aspect, it is possible to suitably execute the partial cylinder operation.

In the control device related to the above aspect, the temperature regulator may include a first water conduction channel and a second water conduction channel. The first water conduction channel may be configured to conduct a cooling water to the operating cylinder. The second water conduction channel may be configured to conduct the cooling water to the paused cylinder. The temperature regulator may be configured to separately regulate an amount of water conduction of the first water conduction channel and an amount of water conduction of the second water conduction channel.

According to this aspect, for example, the first water conduction channel that conducts a cooling water to the operating cylinder, and the second water conduction channel that conducts the cooling water to the paused cylinder are provided, and the temperature of the operating cylinder and the temperature of the paused cylinder are separately regulated by regulating the amounts of water conduction to the first water conduction channel and the second water conduction channel by regulating valves or the like. Therefore, if regulation is performed so as to lower the temperature of a cylinder with a higher temperature or so as to raise the temperature of a low cylinder with a lower temperature, the temperature difference between the operating cylinder and the paused cylinder can be made smaller. Therefore, it is possible to suitably suppress the occurrence of trouble resulting from the temperature difference between the operating cylinder and the paused cylinder.

In addition, the regulation of the temperature of each cylinder can be realized if only the on-off control (namely, the control of performing switching between a state where water conduction is performed and a state where water conduction is not performed) of water conduction of the cooling water can be performed. However, fine adjustment of the temperature difference, the rate adjustment of a temperature change, or the like can be realized, for example, by regulating the amount of water conduction between 0% to 100%.

In the control device related to the above aspect, the electronic control unit may be configured to control the temperature regulator such that the temperature regulator conducts a cooling water only to the operating cylinder when the temperature difference is equal to or smaller than the predetermined threshold. The electronic control unit may be configured to control the temperature regulator such that the temperature regulator conducts the cooling water to the operating cylinder and the paused cylinder when the temperature difference is larger than the predetermined threshold.

According to the above aspect, when the temperature difference between the operating cylinder and the paused cylinder is equal to or smaller than the predetermined threshold (namely, a situation where trouble resulting from the temperature difference does not occur easily), the cooling water is conducted only to the operating cylinder. Hence, the cooling water in this case functions to suppress the temperature rise of the operating cylinder.

On the other hand, when the temperature difference between the operating cylinder and the paused cylinder is larger than the predetermined threshold (namely, a situation where trouble resulting from the temperature difference occurs easily), the cooling water is conducted to both of the operating cylinder and the paused cylinder. Hence, the cooling water in this case functions to suppress the temperature rise of the operating cylinder and raise the temperature of the paused cylinder. That is, not only by cooling the operating cylinder of which the temperature continues rising through operation but also by conducting the cooling water warmed when cooling the operating cylinder to the paused cylinder group, it is possible to raise the temperature of the paused cylinder group with a lower temperature than the operating cylinder.

According to the above aspect, when the temperature difference between the operating cylinder and the paused cylinder is larger than the predetermined threshold, the temperature difference between the operating cylinder and the paused cylinder is surely made smaller. Therefore, it is possible to suitably suppress the occurrence of trouble resulting from the temperature difference between the operating cylinder and the paused cylinder.

In the control device related to the above aspect, the internal combustion engine may include a first temperature sensor that detects the temperature of the operating cylinder and a second temperature sensor that detects the temperature of the paused cylinder. The electronic control unit may be configured to calculate the temperature difference on the basis of detection values of the first temperature sensor and the second temperature sensor.

According to this aspect, in the calculation of the temperature difference by the electronic control unit, the temperature of the operating cylinder and the temperature of the paused cylinder are directly detected, for example, by temperature sensors, such as water temperature sensors for the cooling water. In addition, at least two sensors of the first temperature sensor that detects the temperature of the operating cylinder and the second temperature sensor that detects the temperature of the paused cylinder group may be provided as the temperature sensors.

If detection results using the temperature sensors are used, the temperature difference between the operating cylinder and the paused cylinder can be precisely calculated. For this reason, the temperature difference between the operating cylinder and the paused cylinder can be made to be equal to or smaller than the predetermined threshold with high precision. Therefore, it is possible to suitably suppress the occurrence of trouble resulting from the temperature difference between the operating cylinder and the paused cylinder.

In the control device related to the above aspect, the electronic control unit may be configured to calculate the temperature difference on the basis of the output history of the internal combustion engine.

According to this aspect, in the calculation of the temperature difference by the electronic control unit, the temperature of the operating cylinder and the temperature of the paused cylinder are indirectly detected (estimated) from the output history of the internal combustion engine. Here, the expression "output history of the internal combustion engine" is parameters showing the past operational state of the internal combustion engine, and includes, for example, integrated air volume, engine load, start and stop periods (namely, a period until a vehicle stops after the vehicle starts traveling), and the like. According to an experiment conducted by the present application inventor, these parameters greatly influence the temperature rise of each cylinder, and it has become clear that the temperature of each cylinder can be precisely estimated by using the output history of the internal combustion engine.

For example, the temperature of a cylinder tends to rise higher as the integrated air volume increases. For this reason, for example, if a map showing the relationship between the integrated air volume and rising temperature is created by previous simulation or the like, the temperature of the cylinder can be relatively easily estimated.

In this aspect, particularly, the temperature difference between the operating cylinder and the paused cylinder can be calculated even without arranging a plurality of temperature sensors to directly detect the temperatures of respective cylinders. Therefore, an increase in cost can be suppressed. However, the control of enhancing the precision of the temperature difference calculated, using the temperature sensors together, can be performed. In this way, since the number of temperature sensors can be reduced even in a case where the temperature sensors are used together, a cost reduction effect is exhibited correspondingly.

The operation and other advantages of the invention will become clear from embodiments to be described next.

BRIEF DESCRIPTION OF THE DRAWINGS

Features and advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, an embodiment of a control device for an internal combustion engine will be described.

First, the control device for an internal combustion engine related to the first embodiment will be described with reference to FIGS. 1 to 3.

An engine and its peripheral configuration related to the first embodiment will be described with reference to FIG. 1. Here, FIG. 1 is a schematic configuration diagram illustrating a configuration around the engine related to the first embodiment.

Figure 1:
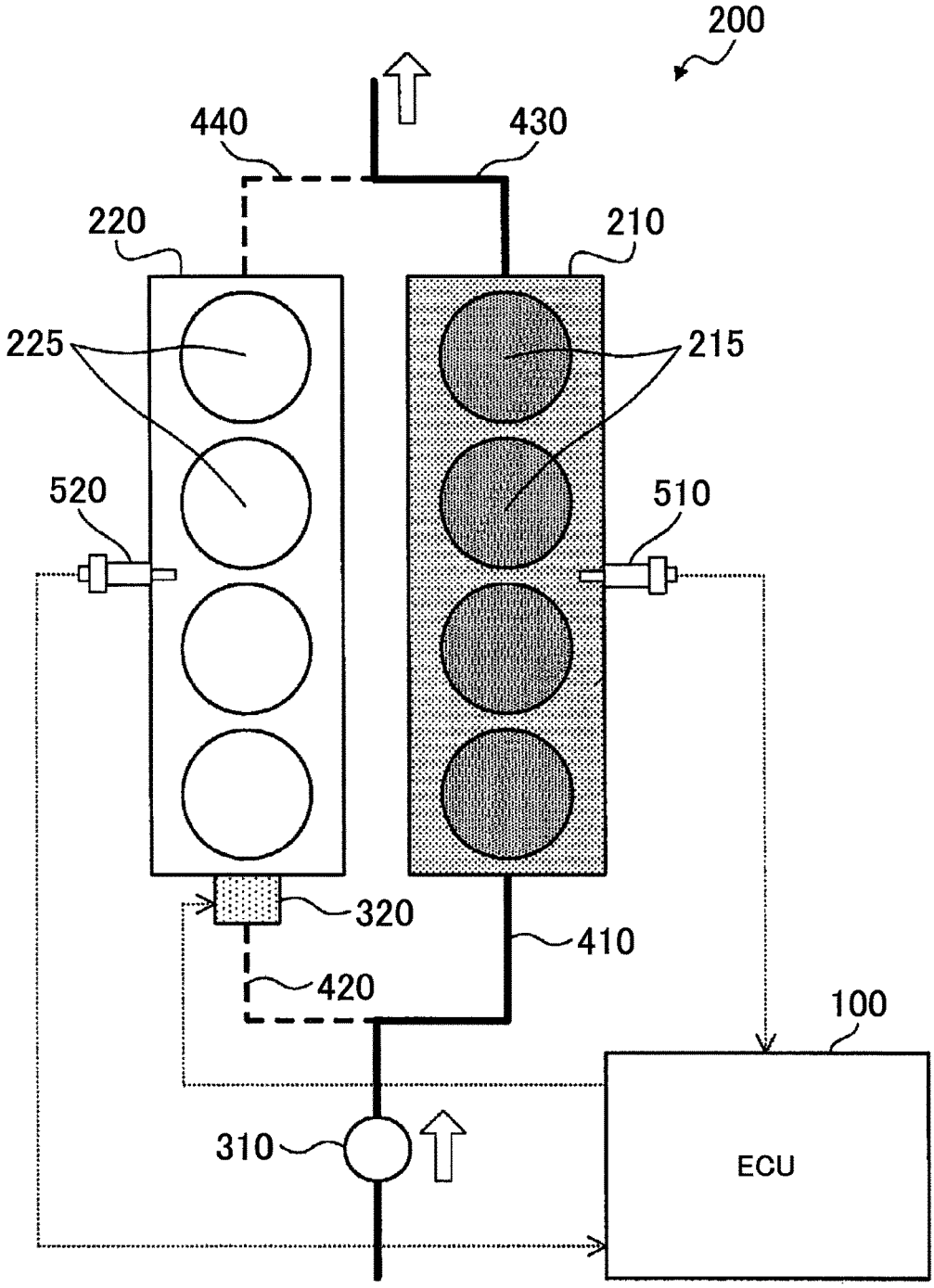
FIG. 1 is a schematic configuration diagram illustrating a configuration around an engine related to a first embodiment.

In FIG. 1, an engine 200 related to the first embodiment is a gasoline engine that is an example of the "internal combustion engine", and is configured to function as a main power source of a vehicle (including a hybrid vehicle). In addition, the "internal combustion engine" is a concept including an engine that has a plurality of cylinders and is configured to be capable of extracting power, which is generated when an air-fuel mixture including, for example, various kinds of fuel, such as gasoline, gas oil, or alcohol, is combusted, as driving power appropriately via, for example, physical or mechanical transmission means, such as pistons, connecting rods, and a crankshaft, in combustion chambers inside the cylinders.

The operation of the engine 200 is controlled by an electronic control unit (ECU) 100. The ECU 100 is configured as one having main portions of "the control device for an internal combustion engine", and is configured to be capable of executing various kinds of control in respective units that constitute the engine 200. The ECU 100 may be configured to be capable of executing general control of a vehicle on which the engine 200 is mounted. The specific configuration of the ECU 100 will be described below in detail.

The engine 200 is configured as a V-type engine having a right bank 210 and a left bank 220. Four right bank cylinders 215 are arranged in the right bank 210. Similarly, four left bank cylinders 225 are arranged in the left bank 220. That is, the engine 200 herein is configured as a V-type eight-cylinder engine.

Here, the engine 200 is configured to be capable of performing mutual switching between an all-cylinder operation in which all the cylinders (namely, all the right bank cylinders 215 and the left bank cylinders 220) are brought into an operational state and a partial cylinder operation in which some cylinders (for example, only the left bank cylinders 225) are brought into a paused state. Shading of the right bank 210 in this drawing shows that the right bank cylinders 215 are in an operational state, and the left bank cylinders 225 of the unshaded left bank 220 show that these cylinders are in a paused state. In the following, cylinders brought into an operational state are referred to as "operating cylinders" or "an operating cylinder group (a plurality of operating cylinders)" during the partial cylinder operation, and cylinders brought into a paused state are referred to as "paused cylinders" or "a paused cylinder group (a plurality of paused cylinders)".

Cooling water is enabled to be conducted to the right bank 210 and the left bank 220 of the engine 200, using a water pump 310. Specifically, the cooling water is supplied to the right bank 210 by a right bank water supply channel 410 (first water conduction channel). The cooling water supplied to the right bank 210 is drained from a right bank water drain channel 430 after passing through a water jacket (not illustrated) provided in each of the right bank cylinders 215. On the other hand, the cooling water is supplied to the left bank 220 by a left bank water supply channel 420 (second water conduction channel). The cooling water supplied to the left bank 220 is drained from a left bank water drain channel 440 after passing through a water jacket (not illustrated) provided in each of the left bank cylinders 225.

In addition, the common cooling water is conducted to the right bank 210 and the left bank 220. The cooling water drained from the right bank 210 and the left bank 220 is circulated and is again supplied to the right bank 210 and the left bank 220.

Here, particularly, an inlet from the left bank water supply channel 420 to the left bank 220 is provided with a left bank water conduction valve 320. The opening degree of the left bank water conduction valve 320 is enabled to be adjusted by the ECU 100, water conduction to the left bank 220 is started by the water conduction valve being opened, and water conduction to the left bank 220 is stopped by the water conduction valve being closed. The left bank water conduction valve 320 is satisfactory so long as two states of a fully-opened state and a fully-closed state can be realized, and may be configured to be capable of stepwisely changing the opening degree thereof, thereby regulating the amount of water conduction.

The above-described cooling system using the cooling water is configured as one specific example of a "temperature regulator". Incidentally, since the right bank water supply channel 410 and the right bank water drain channel 430 in this drawing are in a state where water conduction is performed, these channels are illustrated by thick solid lines. On the other hand, since the left bank water supply channel 420 and the left bank water drain channel 440 are brought into a state where the left bank water conduction valve 320 is closed and water conduction is not performed, these channels are illustrated by dashed lines.

The right bank 210 is provided with a right bank water temperature sensor 510 (first temperature sensor) that detects the temperature of the cooling water conducted to the right bank cylinders 215. Similarly, the left bank 220 is provided with a left bank water temperature sensor 520 (second temperature sensor) that detects the temperature of the cooling water conducted to the left bank cylinders 225. The water temperatures detected in the right bank water temperature sensor 510 and the left bank water temperature sensor 520 are output to the ECU 100.

In addition, for example, wall temperature sensors and oil temperature sensors may be provided instead of the right bank water temperature sensor 510 and the left bank water temperature sensor 520. That is, if the temperature of the right bank cylinder 215 and the temperature of the left bank cylinder 225 are separately detectable, it is also possible to adopt sensors other than the water temperature sensors.

A specific configuration of the ECU related to the first embodiment will be described with reference to FIG. 2. Here, FIG. 2 is a block diagram illustrating the configuration of the ECU related to the first embodiment.

Figure 2:
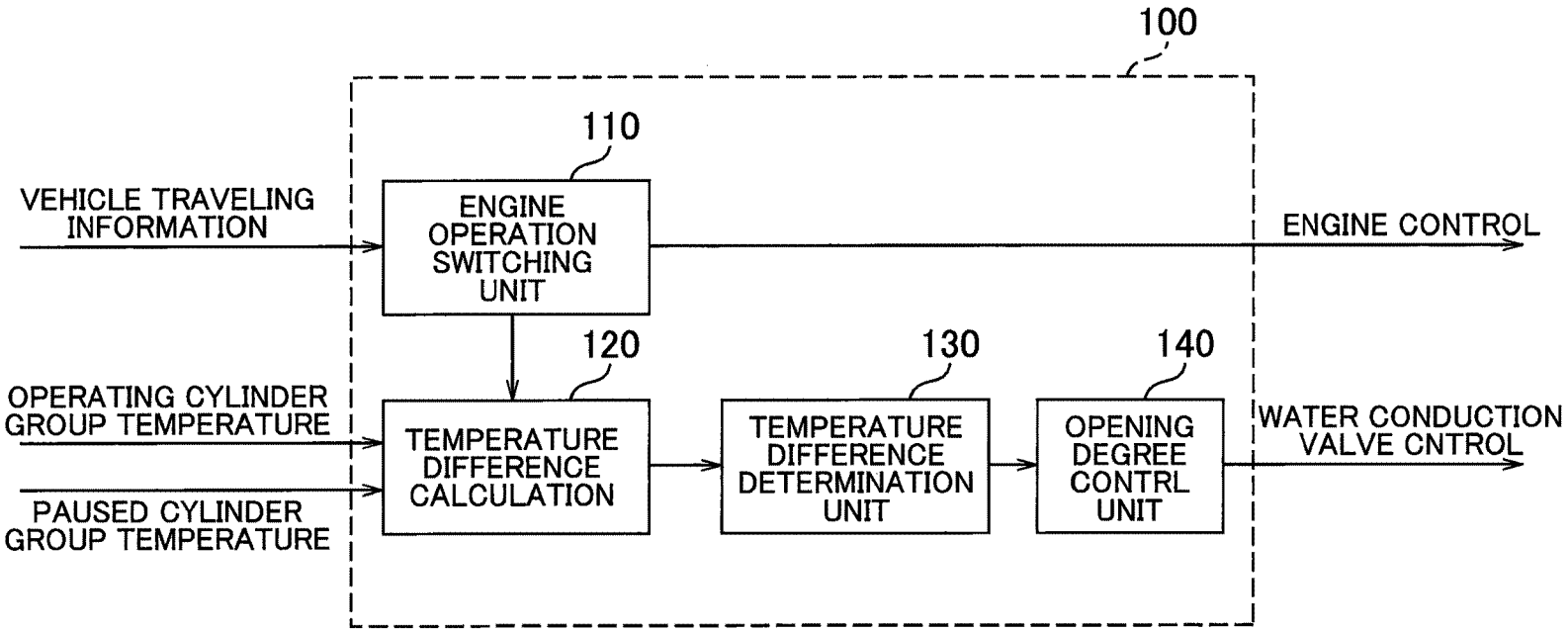
FIG. 2 is a block diagram illustrating the configuration of an ECU related to the first embodiment.

In FIG. 2, the ECU 100 is configured to include an engine operation switching unit 110, a temperature difference calculation unit 120, a temperature difference determination unit 130, and the opening degree control unit 140.

The engine operation switching unit 110 is configured to be capable of performing switching between the all-cylinder operation and the partial cylinder operation, in accordance with the traveling information of a vehicle to be input (for example, a vehicle speed, required driving power, or the like). The engine operation switching unit 110 controls the engine 200 so as to perform the all-cylinder operation, for example, during a high load operation, and controls an engine 200 to perform the partial cylinder operation during a low load operation. The partial cylinder operation has, for example, an effect of improving fuel efficiency compared to the all-cylinder operation.

The temperature difference calculation unit 120 calculates a temperature difference between the operating cylinder group and the paused cylinder group when the partial cylinder operation is selected by the engine operation switching unit 110. For example, as illustrated in FIG. 1, when the right bank 210 is in an operational state and the left bank 220 is in a paused state, the temperature difference calculation unit 120 calculates a difference between the temperature of the right bank cylinders 215 (namely, the operating cylinder group) detected in the right bank water temperature sensor 510 and the temperature of the left bank cylinders 225 (namely, the paused cylinder group) detected in the left bank water temperature sensor 520. The temperature difference calculated in the temperature difference calculation unit 120 is output to the temperature difference determination unit 130.

The temperature difference determination unit 130 determines whether or not the temperature difference calculated in the temperature difference calculation unit 120 is equal to or smaller than a predetermined threshold. The predetermined threshold is a threshold for determining whether or not the temperature difference between the operating cylinder group and the paused cylinder group during the partial cylinder operation is large to such a degree that trouble may occur in the engine 200, is determined, for example, by simulation or the like that is performed in advance, and is stored in a memory of the temperature difference determination unit 130. A determination result obtained by the temperature difference determination unit 130 is output to the opening degree control unit 140.

The opening degree control unit 140 controls the opening degree of the left bank water conduction valve 320 in accordance with the determination result of the temperature difference determination unit 130. The control performed by the opening degree control unit 140 will be described below in detail.

The operation of the control device for an internal combustion engine related to the first embodiment will be described with reference to FIG. 3. Here, FIG. 3 is a flowchart illustrating the operation of the control device for an internal combustion engine related to the first embodiment. In addition, in the following, processing deeply related to the present embodiment in the processing that the ECU 100 functioning as the control device for an internal combustion engine executes will be described in detail, and the description of the other general processing will be appropriately omitted.

Figure 3:
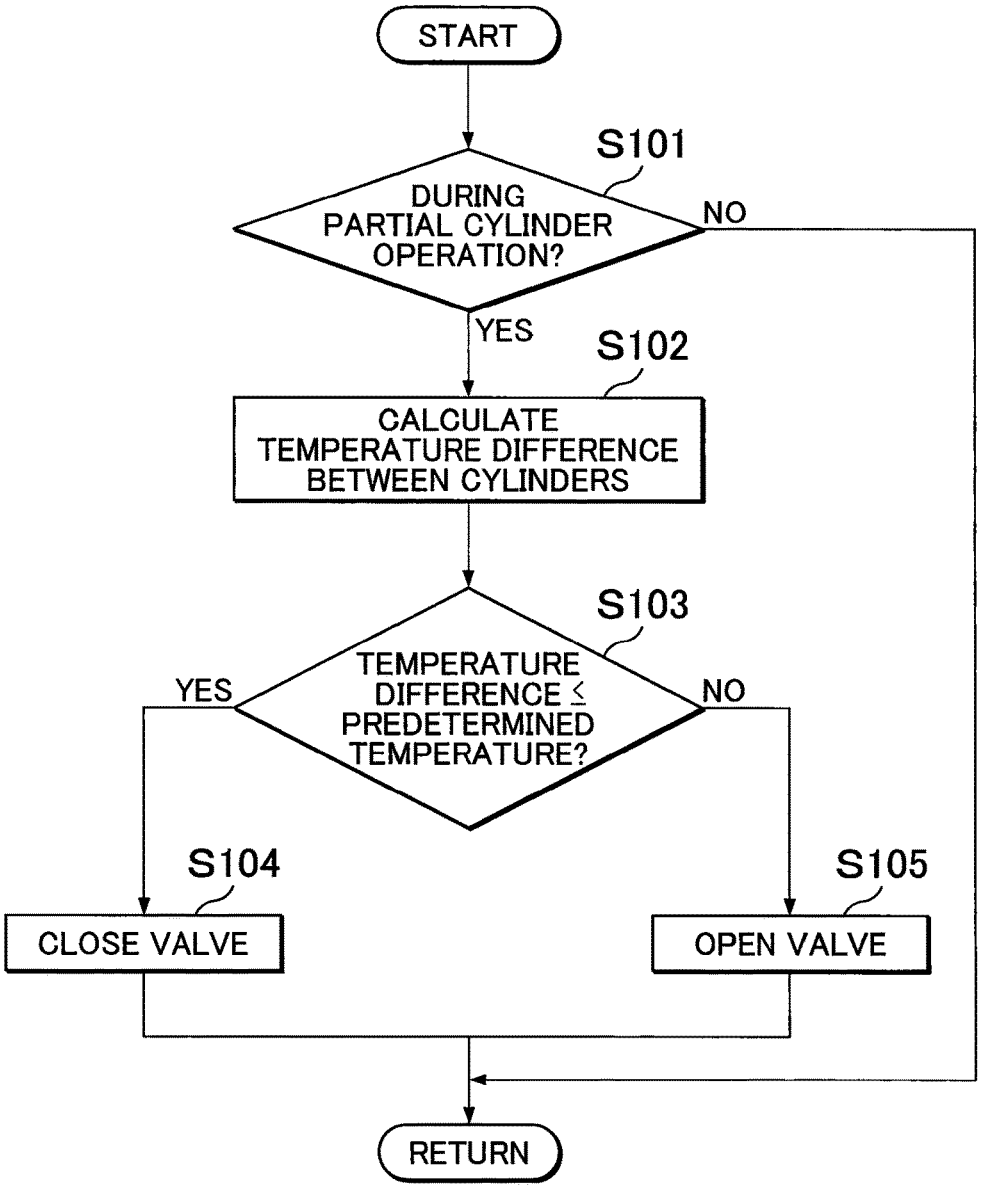
FIG. 3 is a flowchart illustrating the operation of a control device for an internal combustion engine related to the first embodiment.

In FIG. 3, during the operation of the control device for an internal combustion engine related to the first embodiment, first, it is determined whether or not the engine 200 is performing the partial cylinder operation (Step S101). That is, it is determined whether or not the partial cylinder operation is selected in the engine operation switching unit 110. In addition, when it is determined that the engine 200 is not performing the partial cylinder operation (that is, during the all-cylinder operation), (Step S101: NO), to the subsequent processing is omitted.

When the engine 200 is performing the partial cylinder operation (Step S101: YES), a temperature difference between the operating cylinder group (namely, the right bank cylinder 215) and the paused cylinder group (the left bank cylinder 225) is calculated in the temperature difference calculation unit 120 (Step S102). Then, in the temperature difference determination unit 130, it is determined whether or not the calculated temperature difference is equal to or smaller than a predetermined threshold (Step S103). That is, it is determined whether or not the temperature difference between the operating cylinder group and the paused cylinder group is large to such a degree that trouble occurs in the engine 200.

Here, when the temperature difference between the operating cylinder group and the paused cylinder group is equal to or smaller than the predetermined threshold (Step S103: YES), the left bank water conduction valve 320 is closed by the opening degree control unit 140, or when the valve is already in a closed state, the closed state of the valve is continued (Step S104). In this case, water conduction to the left bank 220 is not performed, and only water conduction to the right bank 210 is performed. That is, supply of cooling water to the left bank cylinders 225 that is the paused cylinder group is not performed, and only supply of the cooling water to the right bank cylinders 215 that is the operating cylinder group is performed.

On the other hand, when the temperature difference between the operating cylinder group and the paused cylinder group is larger than the predetermined threshold (Step S103: NO), the left bank water conduction valve 320 is opened by the opening degree control unit 140 (Step S105). In this case, water conduction to both the right bank 210 and the left bank 220 is performed. That is, supply of the cooling water to both of the right bank cylinders 215 that are the operating cylinder group and the left bank cylinders 225 that are the paused cylinder group is performed.

If the water conduction to both the operating cylinder group and the paused cylinder group is performed, the operating cylinder group with a relatively high temperature is cooled, while the temperature of the paused cylinder group with a relatively low temperature is raised. Specifically, first, heat is obtained when the cooling water conducted to the operating cylinder group cools the operating cylinder group. Then, if the cooling water that has obtained the heat is circulated and is conducted to the paused cylinder group, heat is now given to the paused cylinder group with the lower temperature from the cooling water, and the temperature of the paused cylinder group rises. As a result, the temperature of the operating cylinder group falls and the temperature of the paused cylinder group rises. Hence, the temperature difference between the operating cylinder group and the paused cylinder group becomes smaller. Hence, if a state where the left bank water conduction valve 320 is opened is maintained, the temperature difference between the operating cylinder group and the paused cylinder group can be made to be equal to or smaller than the predetermined threshold. Therefore, the occurrence of trouble resulting from the temperature difference between the operating cylinder group and the paused cylinder group can be suppressed. Specifically, for example, torque fluctuations or vehicle vibration resulting from the torque unbalance between the cylinders during shifting to the all-cylinder operation can be suppressed.

In addition, the above-described series of processing is repeated. Therefore, if the temperature difference between the operating cylinder group and the paused cylinder group becomes equal to or smaller than the predetermined threshold, for example, after the left bank water conduction valve 320 is opened, the left bank water conduction valve is closed.

Although a case where the left bank water conduction valve 320 is selectively switched to the two states of a valve-open state and a valve-closed state has been described in the above-described embodiment, adjustment of the opening degree of the left bank water conduction valve may be stepwisely performed. That is, the opening degree of the left bank water conduction valve 320 may be changed to a suitable opening degree between 0% to 100%. For example, when the opening degree of the left bank water conduction valve 320 is made to be 50%, the speed at which the temperature difference between the operating cylinder group and the paused cylinder group decreases can be reduced compared to a case where the opening degree of the left bank water conduction valve 320 is made to be 100%. In this way, when the opening degree of the left bank water conduction valve 320 is controlled in a plurality of steps, a plurality of the predetermined thresholds may be set as values corresponding to respective opening degrees.

As described above, according to the control device for an internal combustion engine related to the first embodiment, it is possible to suitably perform the partial cylinder operation.

Next, a control device for an internal combustion engine related to a second embodiment will be described with reference to FIG. 4. In addition, compared to the above-described first embodiment, the second embodiment is different only in the configuration and operation of some portions, and is almost the same in the other portions. For this reason, in the following, portions different from those of the first embodiment already described will be described, and the description of duplicate portions will be appropriately omitted.

An engine and its peripheral configuration related to the second embodiment will be described with reference to FIG. 4. Here, FIG. 4 is a schematic configuration diagram illustrating a configuration around the engine related to the second embodiment.

Figure 4:
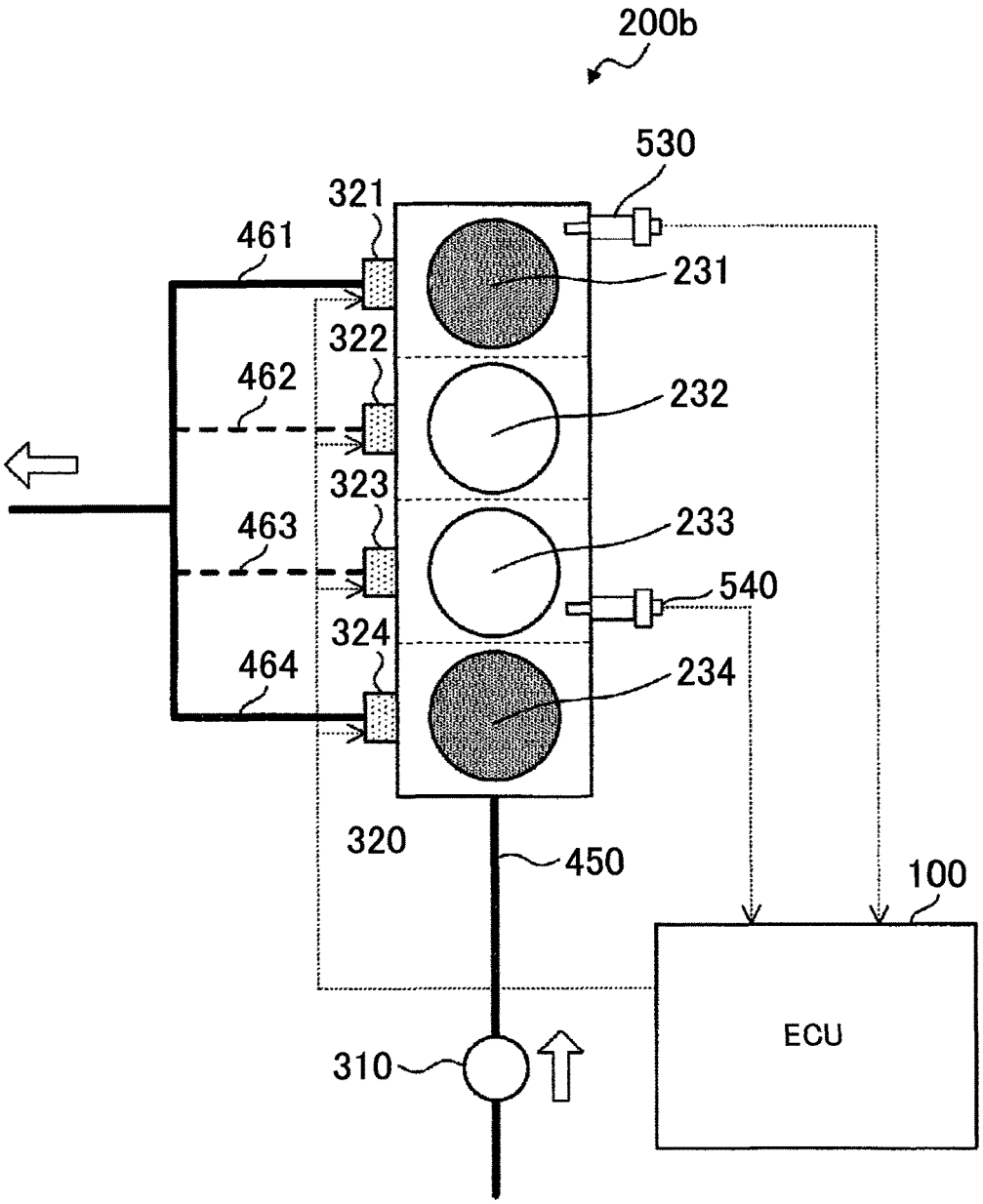
FIG. 4 is a schematic configuration diagram illustrating a configuration around an engine related to a second embodiment.

In FIG. 4, an engine 200*b* related to the second embodiment is configured as a so-called in-line four-cylinder engine in which four cylinders 231, 232, 233, and 234 are tandemly arranged. The engine 200*b* related to the second embodiment is also configured to be capable of performing mutual switching between the all-cylinder operation and the partial cylinder operation, similar to the engine 200 (refer to FIG. 1) related to the first embodiment. Shading of the cylinders 231 and 234 in this drawing shows that the cylinders 231 and 234 are in an operational state, respectively, and the unshaded cylinders 232 and 233 show that these cylinders are in a paused state.

Cooling water is enabled to be conducted to the respective cylinders 231, 232, 233, and 234 of the engine 200*b* by the water pump 310. Specifically, the cooling water is supplied to the cylinders 231, 232, 233, and 234 by a water supply channel 450. The supplied cooling water is drained from water drain channels 461, 462, 463, and 464 provided for the cylinders 231, 232, 233, and 234, respectively. In addition, the drained cooling water is circulated and is again supplied to the cylinders from the water supply channel 450. Here, particularly, the water drain channels 461, 462, 463, and 464 are respectively provided with water conduction valves 321, 322, 323, and 324. The opening degrees of the water conduction valves 321, 322, 323, and 324 are enabled to be respectively adjusted by the ECU 100, water conduction to the corresponding cylinders 231, 232, 233, and 234 is started by the water conduction valves being opened, and water conduction to the corresponding cylinders is stopped by the water conduction valves being closed. That is, the engine 200*b* related to the second embodiment is configured to be capable of individually controlling water conductions to the respective cylinders 231, 232, 233, and 234.

The cylinder 231 is provided with a first water temperature sensor 530. The cylinder 233 is provided with a second water temperature sensor 540. The water temperatures detected in the first water temperature sensor 530 and the second water temperature sensor 540 are output to the ECU 100.

Here, as illustrated in FIG. 4, when the cylinder 231 is brought into an operational state and the cylinder 233 is brought into a paused state, the first water temperature sensor 530 functions as a sensor that detects the temperature of the operating cylinder group, and the second water temperature sensor 540 functions as a sensor that detects the temperature of the paused cylinder group. In this way, in order to detect the temperature of the operating cylinder group and the temperature of the paused cylinder group, the first water temperature sensor 530 and the second water temperature sensor 540 may be arranged in two cylinders of which the operational states are different from each other.

In addition, when transposition control of the operating cylinders and the paused cylinders is possible, and a set of cylinders serving as the operating cylinder group or the paused cylinder group may change (namely, when both of the cylinders 231 and 233 become the operating cylinder group or the paused cylinder group), water temperature sensors may also be arranged in the other cylinders (namely, the cylinders 232 and 234).

According to the engine 200*b* related to the above-described second embodiment, the temperature difference between the operating cylinder group and the paused cylinder group can be calculated similar to the first embodiment. Specifically, the temperature difference between the operating cylinder group and the paused cylinder group can be calculated by calculating a difference between the temperature detected in the first water temperature sensor 530 and the temperature detected in the second water temperature sensor 540.

In the second embodiment, when the temperature difference between the operating cylinder group and the paused cylinder group becomes larger than a predetermined threshold, the temperature difference can be made to be equal to or smaller than the predetermined threshold through water conduction control for each cylinder. Specifically, by controlling the opening degrees of the water conduction valves 321, 322, 323, and 324, water conduction to the paused cylinder group is started or stopped, and the temperature difference from that of the operating cylinder group can be reduced. Therefore, the occurrence of trouble resulting from the temperature difference between the operating cylinder group and the paused cylinder group can be suppressed.

As described above, according to the control device for an internal combustion engine related to the second embodiment, it is possible to suitably perform the partial cylinder operation, similar to the first embodiment (namely, by the same processing as the processing described in FIG. 3).

Next, the control device for an internal combustion engine related to the third embodiment will be described with reference to FIGS. 5 to 9. In addition, compared to the above-described first and second embodiments, the third embodiment is different only in the configuration and operation of some portions, and is almost the same in the other portions. For this reason, in the following, portions different from those of the first and second embodiments already described will be described, and the description of duplicate portions will be appropriately omitted.

An engine and its peripheral configuration related to the third embodiment will be described with reference to FIG. 5. Here, FIG. 5 is a schematic configuration diagram illustrating a configuration around the engine related to the third embodiment.

Figure 5:
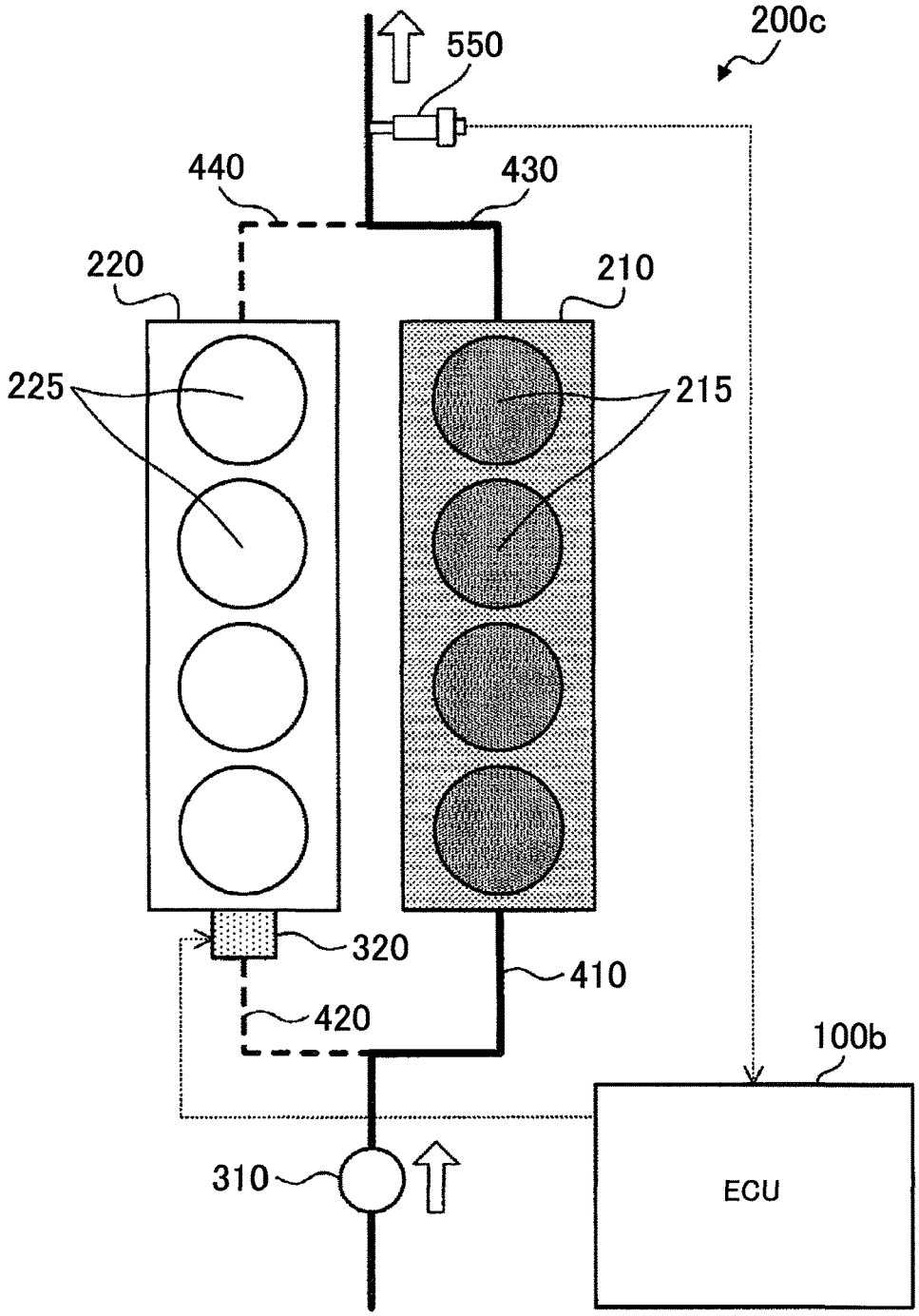
FIG. 5 is a schematic configuration diagram illustrating a configuration around an engine related to a third embodiment.

In FIG. 5, an engine 200*c* related to the third embodiment is configured as a V-type eight-cylinder engine, similar to the engine 200 related to the first embodiment. However, in the engine 200*c* related to the third embodiment, no water temperature sensor is provided at each of the right bank 210 and the left bank 220 unlike the first embodiment. In the engine 200*c*, a water temperature sensor 550 is provided at a water drain channel portion (namely, on the downstream side of a merging point of the right bank water drain channel 430 and the left bank water drain channel 440).

A specific configuration of the ECU related to the third embodiment will be described with reference to FIG. 6. Here, FIG. 6 is a block diagram illustrating the configuration of the ECU related to the third embodiment.

Figure 6:
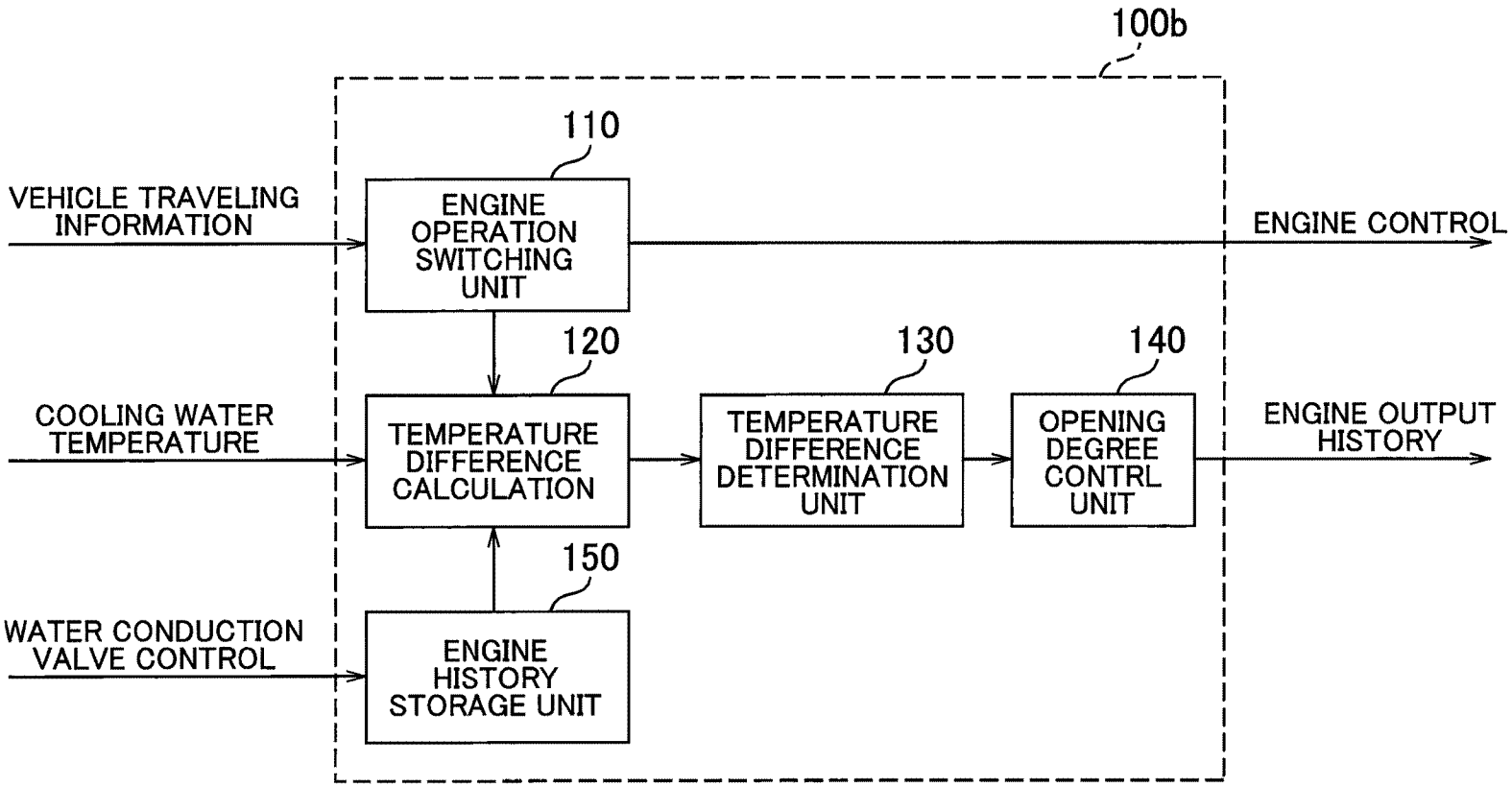
FIG. 6 is a block diagram illustrating the configuration of an ECU related to the third embodiment.

In FIG. 6, an ECU 100*b* related to the third embodiment is configured to include an engine history storage unit 150, in addition to the engine operation switching unit 110, the temperature difference calculation unit 120, the temperature difference determination unit 130, and the opening degree control unit 140, which are already described in the first embodiment.

The engine history storage unit 150 is configured to include, for example, storage means, such as a memory, and stores the output history (for example, integrated air volume, load, start and stop periods, and the like) of the engine 200*c*. The engine history storage unit 150 outputs the stored output history of the engine 200*c* in accordance with a request from the temperature difference calculation unit 120.

The temperature difference calculation unit 120 related to the third embodiment does not calculate the temperature difference from the temperature of the operating cylinder group and the temperature of the paused cylinder group that are detected directly, unlike the first and second embodiment, but calculates the temperature difference between the operating cylinder group and the paused cylinder group, on the basis of the output history of the engine 200*c* acquired from the engine history storage unit 150. In addition, the temperature difference calculation unit 120 may calculate the temperature difference between the operating cylinder group and the paused cylinder group, using a cooling water temperature detected in the water temperature sensor 550 in addition to the output history of the engine 200*c*. A specific method for calculating the temperature difference will be described below in detail.

The operation of the control device for an internal combustion engine related to the third embodiment will be described with reference to FIG. 7. Here, FIG. 7 is a flowchart illustrating the operation of the control device for an internal combustion engine related to the third embodiment.

Figure 7:
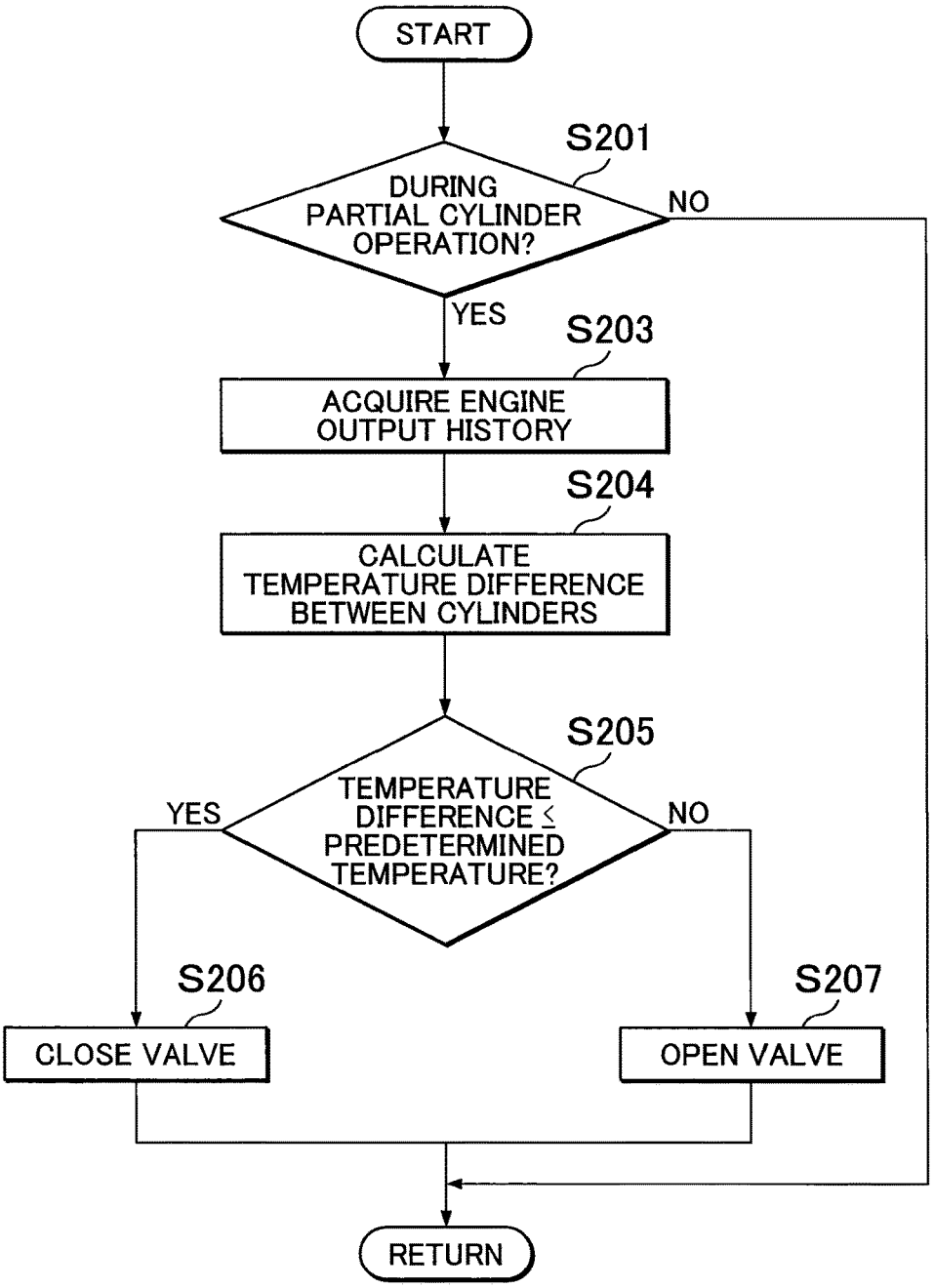
FIG. 7 is a flowchart illustrating the operation of a control device for an internal combustion engine related to the third embodiment.

In FIG. 7, during the operation of the control device for an internal combustion engine related to the third embodiment, first, it is determined whether or not the engine 200*c* is performing the partial cylinder operation (Step S201). That is, it is determined whether or not the partial cylinder operation is selected in the engine operation switching unit 110. In addition, when it is determined that the engine 200*c* is not performing the partial cylinder operation (that is, during the all-cylinder operation), (Step S201: NO), the subsequent processing is omitted.

When the engine 200*c* is performing the partial cylinder operation (Step S201: YES), the output history of the engine 200*c* is acquired from the engine history storage unit 150 by the temperature difference calculation unit 120 (Step S202). Then, in the temperature difference calculation unit 120, the temperature difference between the operating cylinder group (namely, the right bank cylinders 215) and the paused cylinder group (the left bank cylinders 225) is calculated on the basis of the acquired output history of the engine 200*c* (Step S203).

Figure 8:
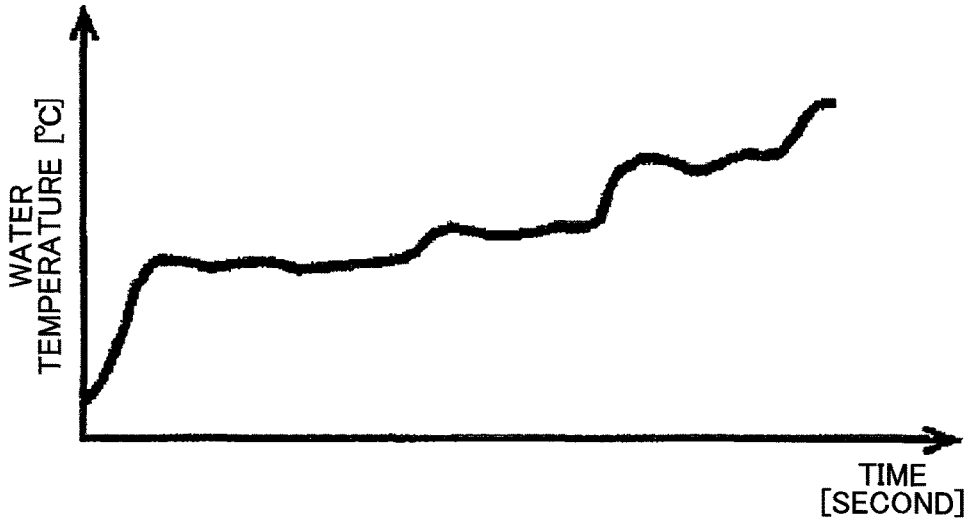
FIG. 8 is a graph illustrating the relationship between engine operation time and cooling water temperature.
Figure 9:
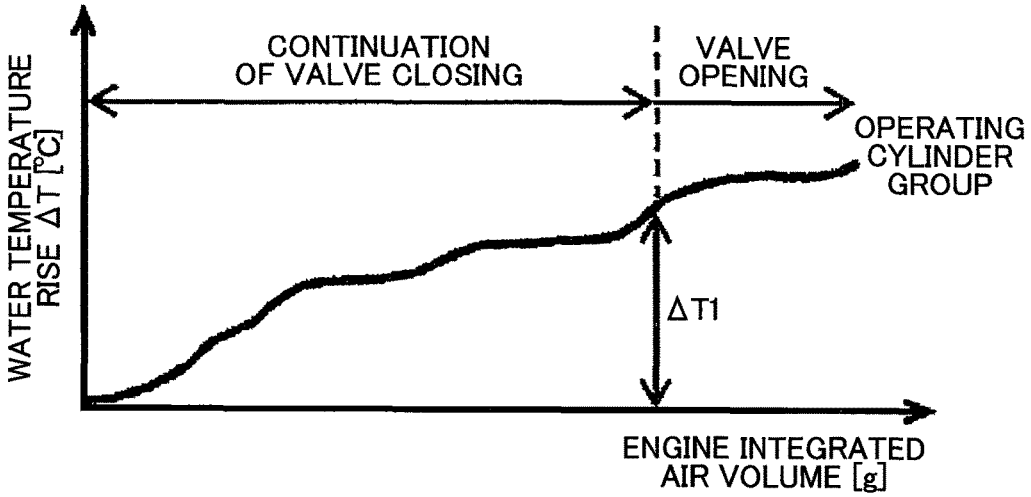
FIG. 9 is a map illustrating the relationship between engine integrated air volume and cooling water rising temperature related to the third embodiment.

In the following, calculation of the temperature difference using the output history of the engine 200*c* will be specifically described with reference to FIGS. 8 and 9. Here, FIG. 8 is a graph illustrating the relationship between engine operation time and cooling water temperature. FIG. 9 is a map illustrating the relationship between engine integrated air volume and cooling water rising temperature related to the third embodiment.

As illustrated in FIG. 8, according to the study of the present application inventor, it becomes clear that, as the operation time of the engine 200*c* becomes longer, there is a tendency in which the water temperature of the cooling water rises. Hence, if the output history of the engine is used, the current water temperature (in other words, the temperature of the cylinders) of the cooling water can be estimated.

As illustrated in FIG. 9, a map showing the relative relationship between the integrated air volume of the engine 200*c* and a water temperature rise difference $\Delta T$ between the operating cylinder group and the paused cylinder group (namely, the temperature difference between the operating cylinder group and the paused cylinder group) can be created, for example by previous simulation. If such a map is created, the temperature difference between the operating cylinder group and the paused cylinder group can be easily calculated with high precision, using the output history of the engine 200*c*.

In addition, the cooling water temperature detected in the water temperature sensor 550 may be used in order to enhance the calculation precision of the temperature difference using the output history of the engine 200*c*. Specifically, while the engine 200*c* stops, for example due to waiting for a signal or the like, the left bank water conduction valve 320 may be opened to also perform water conduction to the left bank 220 side, and the temperature difference may be adjusted in accordance with a change in a detection value obtained by the water temperature sensor 550 in that case.

Referring back to FIG. 7, if the temperature difference between the operating cylinder group and the paused cylinder group is calculated, in the temperature difference determination unit 130, it is determined whether or not the calculated temperature difference is equal to or smaller than the predetermined threshold (Step S204). That is, it is determined whether or not the temperature difference between the operating cylinder group and the paused cylinder group is large to such a degree that trouble occurs in the engine 200*c*.

Here, when the temperature difference between the operating cylinder group and the paused cylinder group is equal to or smaller than the predetermined threshold (Step S204: YES), the left bank water conduction valve 320 is closed by the opening degree control unit 140, or when the valve is already in a closed state, the closing of the valve is continued (Step S205). In this case, water conduction to the left bank 220 is not performed, and only water conduction to the right bank 210 is performed. On the other hand, when the temperature difference between the operating cylinder group and the paused cylinder group is larger than the predetermined threshold (Step S204: NO), the left bank water conduction valve 320 is opened by the opening degree control unit 140 (Step S206). In this case, water conduction to both the right bank 210 and the left bank 220 is performed.

As described above, according to the control device for an internal combustion engine related to the third embodiment, the water conduction control is executed in accordance with the temperature difference between the operating cylinder group and the paused cylinder group, which is estimated from the output history of the engine 200*c*. Hence, similar to the first and second embodiments, it is possible to suitably perform the partial cylinder operation, avoiding the occurrence of trouble.

Particularly the third embodiment does not require that the plurality of water temperature sensors are arranged to detect the temperatures of the operating cylinder group and the paused cylinder group, unlike the first and second embodiments. Therefore, an increase in cost can be suppressed.

Next, a control device for an internal combustion engine related to a fourth embodiment will be described with reference to FIGS. 10 and 11. In addition, compared to the above-described third embodiment, the fourth embodiment is different only in the configuration and operation of some portions, and is almost the same in the other portions. For this reason, in the following, portions different from those of the third embodiment already described will be described, and the description of duplicate portions will be appropriately omitted.

An engine and its peripheral configuration related to a fourth embodiment will be described with reference to FIG. 4. Here, FIG. 10 is a schematic configuration diagram illustrating a configuration around the engine related to the fourth embodiment.

Figure 10:
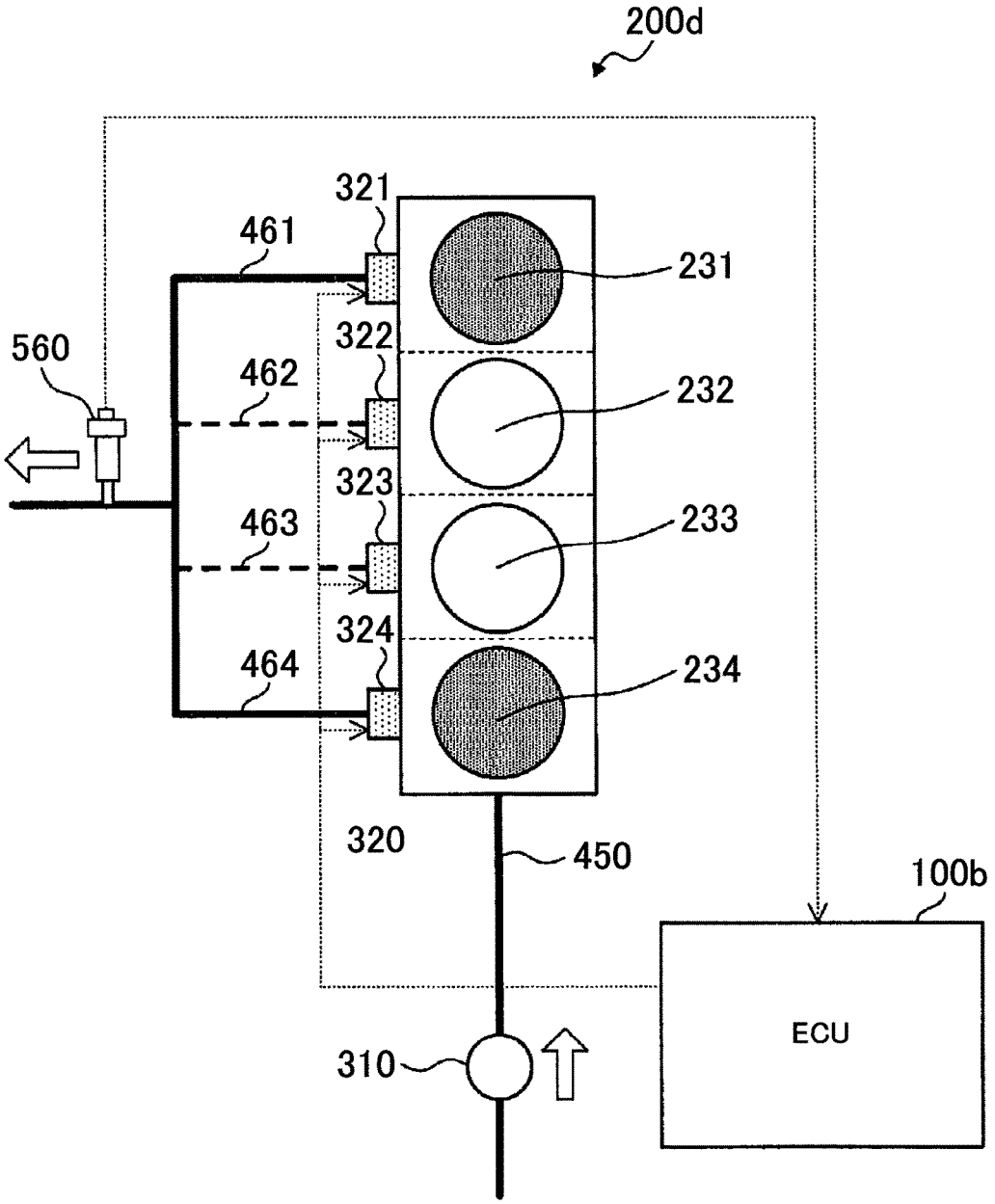
FIG. 10 is a schematic configuration diagram illustrating a configuration around an engine related to a fourth embodiment.

In FIG. 10, an engine 200*d* related to the fourth embodiment is configured as an in-line four-cylinder engine, similar to the engine 200*b* related to the second embodiment. However, the engine 200*d* related to the fourth embodiment is not provided with the first water temperature sensor 530 and the second water temperature sensor 540, unlike the second embodiment. That is, the plurality of water temperature sensors that detect the temperatures of the operating cylinder group and the temperature of the paused cylinder group are not provided. In the engine 200*d*, a water temperature sensor 560 is provided at a water drain channel portion (namely, on the downstream side of a merging point of the water drain channels 461, 462, 463, and 464 provided for each of the cylinders 231, 232, 233, and 234), similar to the third embodiment.

According to the engine 200*d* related to the above-described fourth embodiment, similar to the third embodiment, the temperature difference between the operating cylinder group and the paused cylinder group can be calculated using the output history of the engine 200*d*. Hence, when the temperature difference between the operating cylinder group and the paused cylinder group becomes larger than the predetermined threshold, the temperature difference can be made to be equal to or smaller than the predetermined threshold through water conduction control for each cylinder. Specifically, by controlling the opening degrees of the water conduction valves 321, 322, 323, and 324, water conduction to the paused cylinder group is started or stopped, and the temperature difference from that of the operating cylinder group can be reduced. Therefore, the occurrence of trouble resulting from the temperature difference between the operating cylinder group and the paused cylinder group can be suppressed.

Here, particularly, in an in-line engine like the engine 200*d* related to the fourth embodiment, adjacent cylinders can be brought into different states. Therefore, it is preferable to calculate the temperature difference between the operating cylinder group and the paused cylinder group in consideration of heat received between the cylinders.

For example, in the example illustrated in FIG. 10, since the cylinder 231 in an operational state and the cylinder 232 in a paused state are adjacent to each other, it is considered that transfer of heat is performed with respect to the cylinder 232 with a relatively low temperature in the paused state from the cylinder 231 with a relatively high temperature in the operational state. Similarly, in FIG. 10, since the cylinder 234 in an operational state and the cylinder 233 in a paused state are adjacent to each other, it is considered that transfer of heat is performed with respect to the cylinder 233 with a relatively low temperature in the paused state from the cylinder 234 with a relatively high temperature in the operational state.

Next, a method for calculating the temperature difference between the operating cylinder group and paused cylinder group in the fourth embodiment will be specifically described with reference to FIG. 11. Here, FIG. 11 is a map illustrating the relationship between engine integrated air volume and cooling water rising temperature related to the fourth embodiment.

Figure 11:
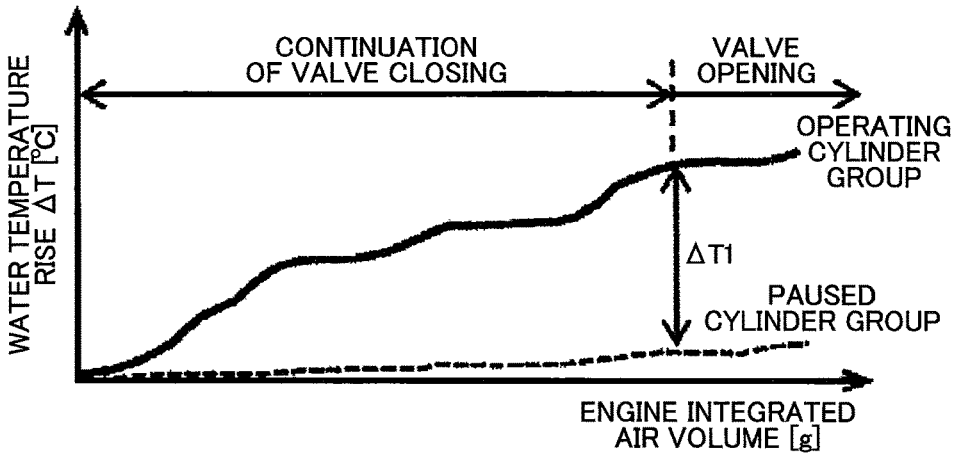
FIG. 11 is a map illustrating the relationship between engine integrated air volume and cooling water rising temperature related to the fourth embodiment.

As illustrated in FIG. 11, in the engine 200*d* related to the fourth embodiment, with an increase in the engine integrated air volume, not only the water temperature (refer to the solid line in a FIG.) of the operating cylinder group but the water temperature (refer to the dashed line in a FIG.) of the paused cylinder group rises. That is, the method for calculating the temperature difference between the operating cylinder group and the paused cylinder group is different from that of the third embodiment (refer to FIG. 9) in which it is enough to take into consideration only the water temperature rise of the operating cylinder group.

However, if the map as illustrated in FIG. 11 is created by previous simulation or the like, the temperature difference between the operating cylinder group and the paused cylinder group can be easily calculated with high precision on the basis of engine integrated air volume. Hence, even in the in-line engine in which heat received between the cylinders is taken into consideration, the temperature difference with the operating cylinder group and the paused cylinder group can be calculated similar to the case of the V-type engine.

As described above, according to the control device for an internal combustion engine related to the fourth embodiment, it is possible to suitably perform the partial cylinder operation, similar to the third embodiment (namely, by the same processing as the processing described in FIG. 7).

The invention is not limited to the above-described embodiment, and can be appropriately changed without departing from the scope or concept of the invention that can be read throughout the claims and the specification, and control devices for an internal combustion engine accompanied with such change are also included in the technical scope of the invention.

The invention claimed is:

1. A control device for an internal combustion engine, the internal combustion engine configured to perform switching between an all-cylinder operation and a partial cylinder operation, the internal combustion engine including a temperature regulator, the temperature regulator being configured to separately regulate the temperature of an operating cylinder and the temperature of a paused cylinder, the operating cylinder being a cylinder that operates during the partial cylinder operation, and the paused cylinder being a cylinder that is paused during the partial cylinder operation, the control device comprising:

an electronic control unit configured to:

switch between the all-cylinder operation and the partial cylinder operation;

calculate a temperature difference between the operating cylinder and the paused cylinder during the partial cylinder operation; and control the temperature regulator such that the temperature difference becomes equal to or smaller than a predetermined threshold, wherein:

the temperature regulator includes a cooling water supply channel that is divided upstream of the operating cylinder and the paused cylinder into a first water conduction channel and a second water conduction channel;

the first water conduction channel is configured to conduct a cooling water to the operating cylinder, the second water conduction channel is configured to conduct the cooling water to the paused cylinder;

the temperature regulator is configured to separately regulate an amount of water conduction of the first water conduction channel and an amount of water conduction of the second water conduction channel;

the electronic control unit is configured to control the temperature regulator such that the temperature regulator conducts a cooling water only to the operating cylinder when the temperature difference is equal to or smaller than the predetermined threshold; and the electronic control unit is configured to control the temperature regulator such that the temperature regulator conducts the cooling water to the operating cylinder and the paused cylinder when the temperature difference is larger than the predetermined threshold.

2. The control device according to claim 1, wherein the internal combustion engine includes a first temperature sensor that detects the temperature of the operating cylinder and a second temperature sensor that detects the temperature of the paused cylinder, and the electronic control unit is configured to calculate the temperature difference on the basis of detection values of the first temperature sensor and the second temperature sensor.

3. The control device according to claim 1, wherein the electronic control unit is configured to calculate the temperature difference on the basis of the output history of the internal combustion engine.

4. The control device according to claim 1, wherein the operating cylinder is a plurality of the operating cylinders.

5. The control device according to claim 1, wherein the paused cylinder is a plurality of the paused cylinders.

* * * * *